US007152774B2

(12) United States Patent
Chen

(10) Patent No.: US 7,152,774 B2
(45) Date of Patent: Dec. 26, 2006

(54) NAIL GUN

(75) Inventor: Mu-Yu Chen, Taichung (TW)

(73) Assignee: Aplus Pneumatic Corp., Ching-Sui Chen (TW)

( * ) Notice: Subject to any disclaimer, the term of this patent is extended or adjusted under 35 U.S.C. 154(b) by 0 days.

(21) Appl. No.: 11/028,025

(22) Filed: Jan. 3, 2005

(65) Prior Publication Data

US 2006/0144892 A1 Jul. 6, 2006

(51) Int. Cl.
*B25C 5/00* (2006.01)

(52) U.S. Cl. ..... 227/131; 227/8; 227/146; 227/129; 227/130

(58) Field of Classification Search ..... 227/131, 227/8, 146, 129, 130
See application file for complete search history.

(56) References Cited

U.S. PATENT DOCUMENTS

| | | | | |
|---|---|---|---|---|
| 4,834,278 | A * | 5/1989 | Lin | 227/7 |
| 4,953,774 | A * | 9/1990 | Lai | 227/131 |
| 5,004,140 | A | 4/1991 | Fushiya et al. | 227/8 |
| 5,118,023 | A * | 6/1992 | Fushiya et al. | 227/8 |
| 5,720,423 | A * | 2/1998 | Kondo et al. | 227/130 |

* cited by examiner

*Primary Examiner*—Stephen F. Gerrity
*Assistant Examiner*—Michelle Lopez
(74) *Attorney, Agent, or Firm*—Alan D. Kamrath; Nikolai & Mersereau, P.A.

(57) ABSTRACT

A nail gun includes a shell, a hammering device for firing nails, an energizing device for providing energy to the hammering device, an actuating device for actuating the energizing device and a lever for disabling the actuating device after a nail is fired. The actuating device can be reset in order to allow the firing of one more nail.

9 Claims, 13 Drawing Sheets

NAIL GUN

BACKGROUND OF INVENTION

1. Field of Invention

The present invention relates to a nail gun that after firing a nail, does not fire another nail until it is disengaged from and engaged again with a work-piece.

2. Related Prior Art

According to U.S. Pat. No. 5,004,140, a conventional nail gun includes a switch 14, a trigger 16, a long pressing element 17, a short pressing element 18, a disc 10, a short pin 11, a long pin 12, a control member 19 and a lever 20. The structure and operation of this conventional nail gun are complicated for the use of two pressing elements 17 and 18. The operation of this conventional nail gun is not reliable for the use of the pressing elements 17 and 18.

The present invention is therefore intended to obviate or at least alleviate the problems encountered in the prior art.

SUMMARY OF INVENTION

According to the present invention, a nail gun includes a shell, a hammering device for firing nails, an energizing device for providing energy to the hammering device, an actuating device for actuating the energizing device and a lever for disabling the actuating device after a nail is fired. The actuating device can be reset in order to allow the firing of one more nail.

The primary advantage of the nail gun according to the present invention is its simplicity both in structure and operation compared with the conventional nail gun discussed in the Related Prior Art.

Other objects, advantages and novel features of the invention will become more apparent from the following detailed description in conjunction with the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
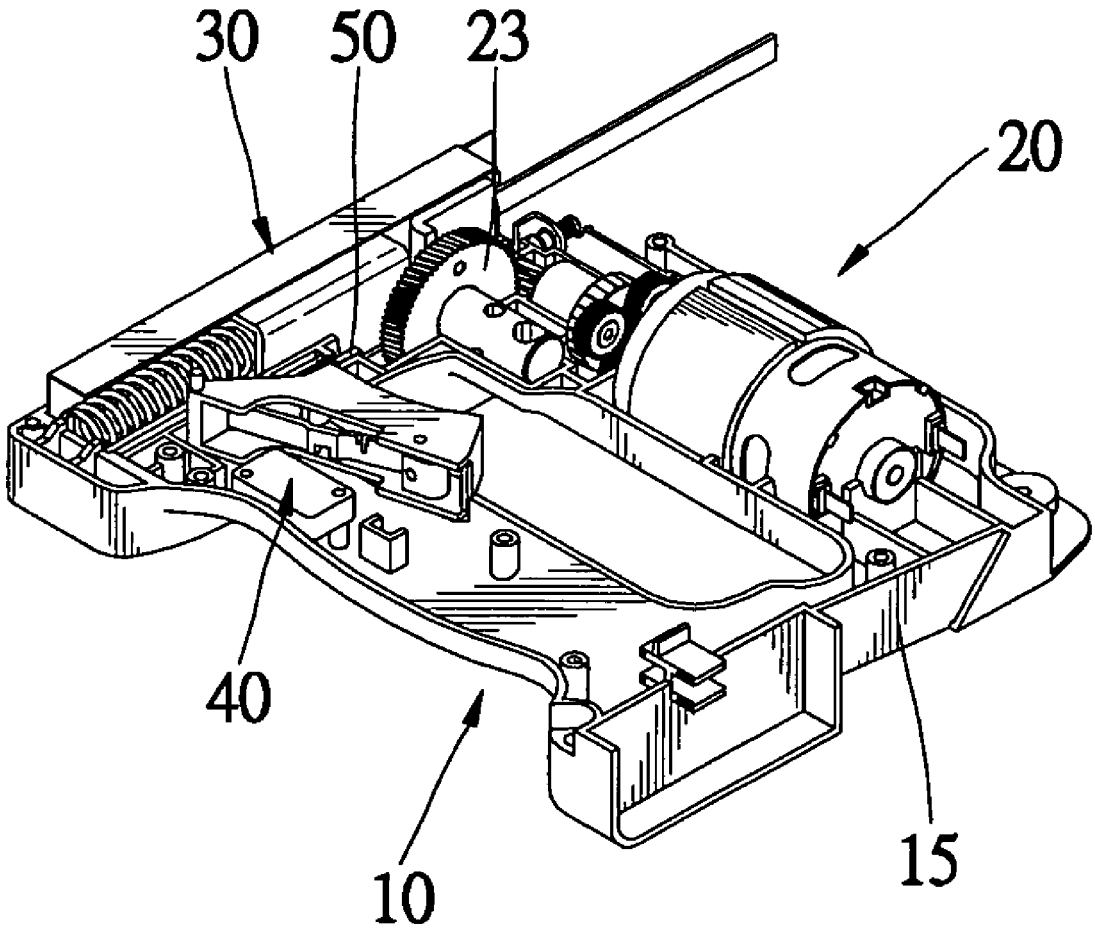
FIG. 1 is a perspective view of a nail gun according to the present invention.

Referring to FIG. 1, a nail gun 10 includes a shell 15, a hammering device 30 for hammering nails, an energizing device 20 for providing energy to the hammering device 30, an actuating device 40 for actuating the energizing device 20 and a lever 50 for disabling the actuating device 40 after a nail is fired. The actuating device 40 can be reset in order to allow the firing of one more nail.

Figure 2:
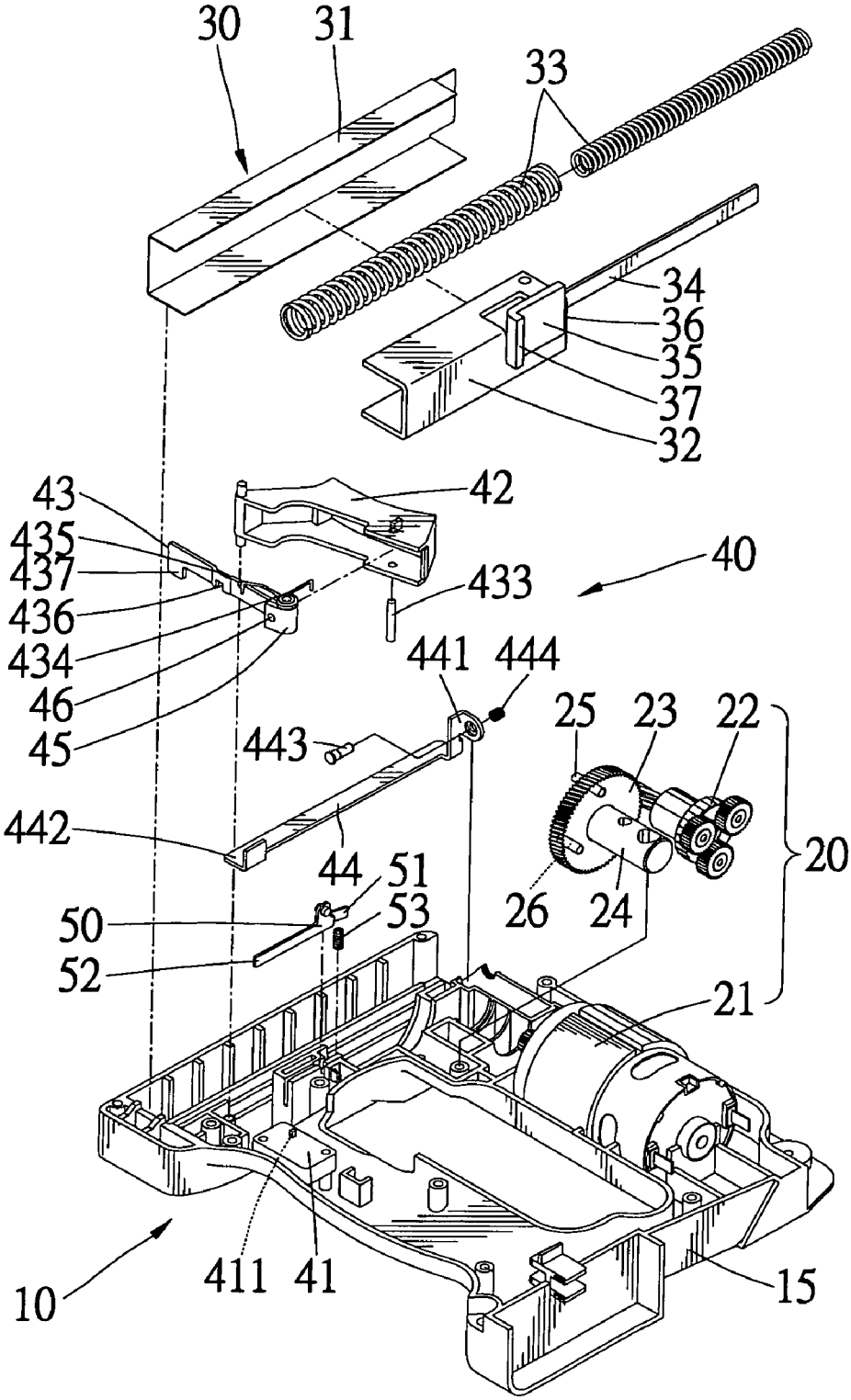
FIG. 2 is an exploded view of the nail gun of FIG. 1.
Figure 3:
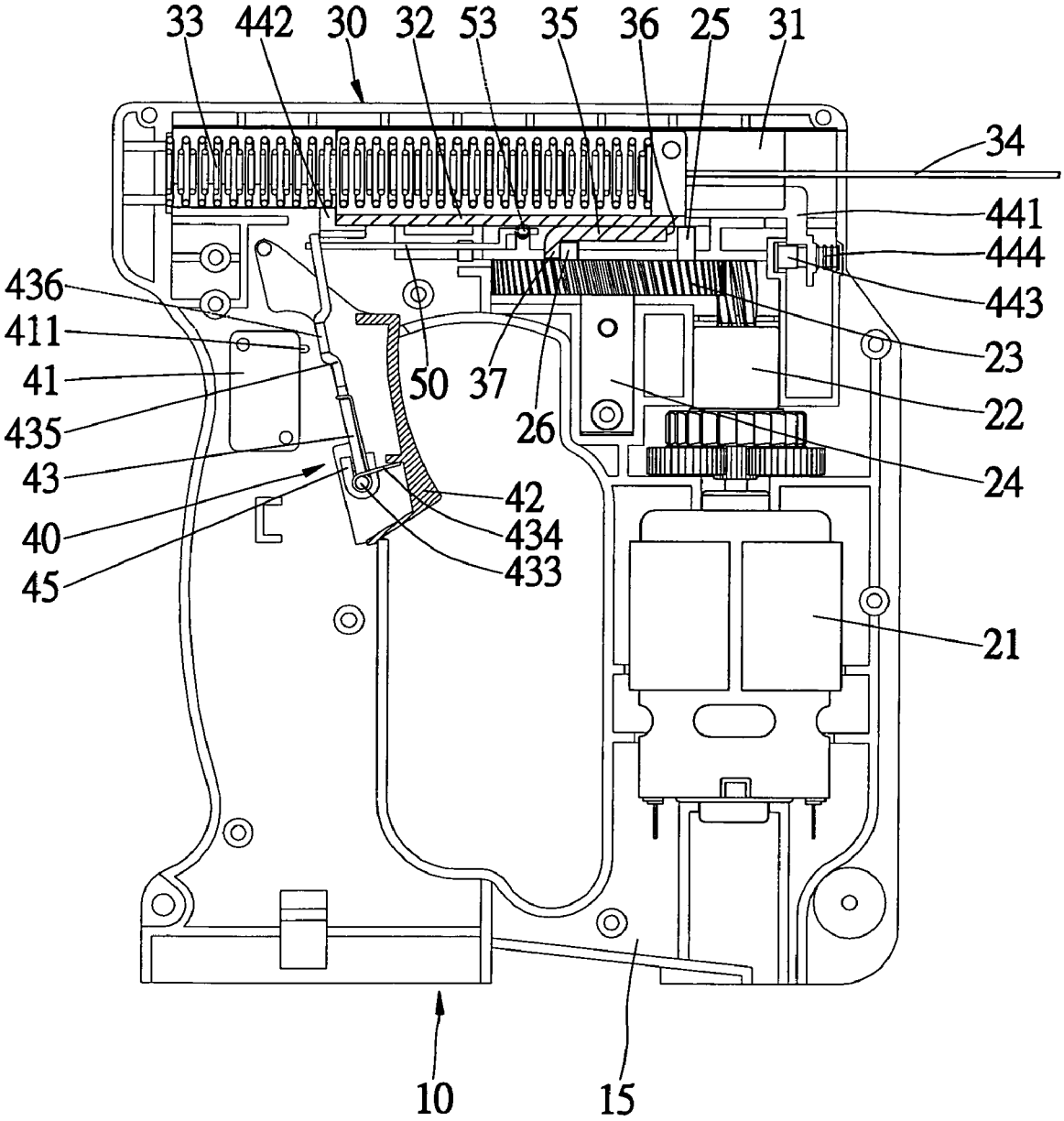
FIG. 3 is a side view of the nail gun of FIG. 2.

Referring to FIGS. 2 and 3, the energizing device 20 includes a motor 21 installed in the shell 15, a transmission 22 connected with the motor 21, a gear 23 connected with the transmission 22, and a shaft 24 for installing the gear 23 rotationally in the shell 15. A short rod 26 and a long rod 25 extend from a side of the gear 23.

The hammering device 30 includes a trough 31 installed in the shell 15, a hammer 32 movable in the trough 31, a pusher 34 secured to the hammer 32 and two springs 33 compressed between a portion of the shell 15 and a portion of the hammer 32. A tab 35 is attached to the hammer 32. The tab 35 includes a transverse end 37 for engagement with the short rod 26 and a co-planar end 36 for engagement with the long rod 25.

The actuating device 40 includes a switch 41 installed in the shell 15, a trigger 42 installed on the shell 15, a pressing element 43 provided between the trigger 42 and a button 411 of the switch 41 and a security element 44 connected with the pressing element 43.

The switch 41 is electrically connected with the motor 21. When the button 411 of the switch 41 is pressed, the motor 21 is actuated.

The trigger 42 is pivotally connected with the shell 15 at an end.

A U-shaped element 45 is installed about a pin 433 inserted in an opposite end of the trigger 42. A first end of the pressing element 43 is connected with the U-shaped element 45 by a pin 46 extending substantially perpendicular to the pin 433. The pressing element 43 includes a pressing portion 435 between the first end and a second end, a cutout 436 next to the pressing portion 435 and a tab 437 formed at the second end.

A spring 434 is installed on the pin 433 and between the trigger 42 and the pressing element 43 in order to pivot the pressing element 43 about the pin 433 on one hand and pivot about the pin 46 on the other hand.

The security element 44 includes a ring 441 at a first end and a tab 442 at an opposite end. The ring 441 is installed on a guiding rod 443 fit in the shell 15. A spring 444 is put on the guiding rod 443 and compressed between a head of the guiding rod 443 and the ring 441. The tab 442 is engaged with the tab 437.

The lever 50 is pivotally connected with the shell 15. The lever 50 includes a first end 51 and a second end 52. The second end 52 of the lever 50 can be engaged with the pressing element 43. A spring 53 is compressed between the first end 51 of the lever 50 and a portion of the shell 15 in order to move the second end 52 of the lever 50 from the pressing element 43.

Figure 4:
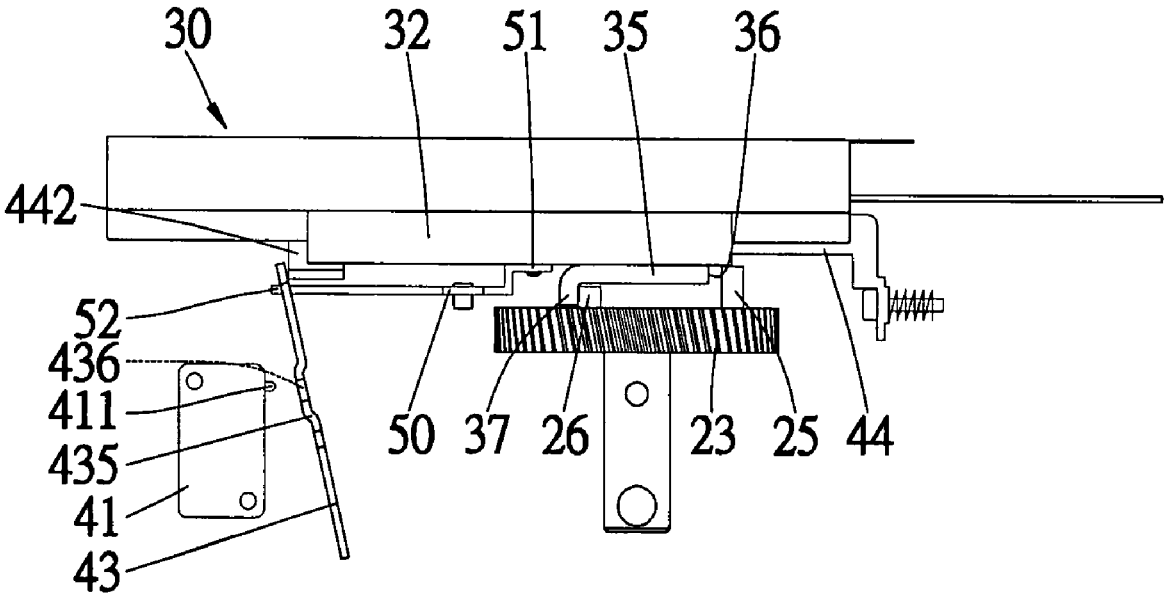
FIG. 4 is a partial view of the nail gun of FIG. 3.
Figure 5:
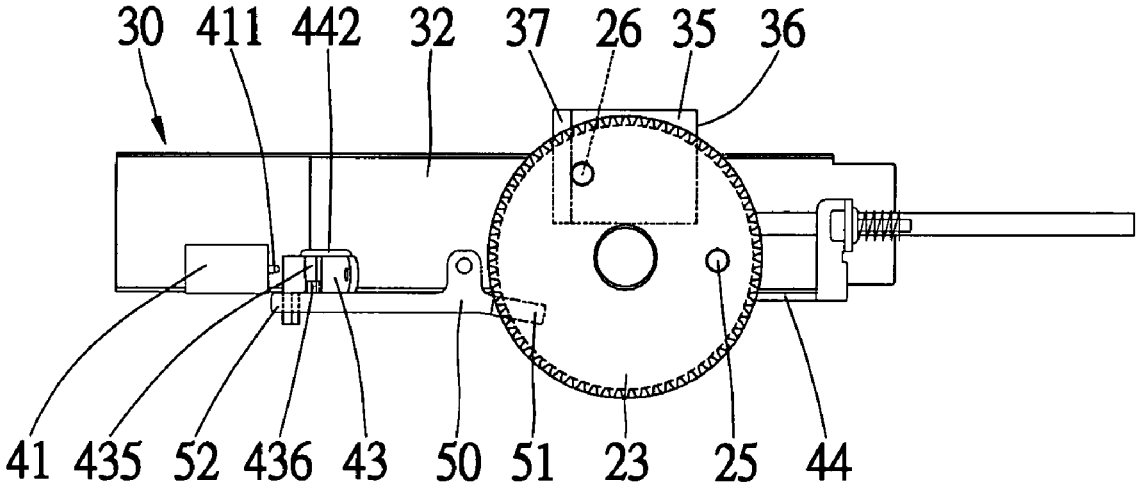
FIG. 5 is a bottom view of the nail gun of FIG. 4.

Referring to FIGS. 4 and 5, the first end of the security element 44 is pressed against a work-piece through a cartridge (not shown) so that the second end of the security element 44 pushes the second end of the pressing element 43, thus pivoting the pressing element 43 about the pin 433. The short rod 26 contacts the transverse end 37 of the tab 35 so that the hammer 32 is kept in position.

Figure 6:
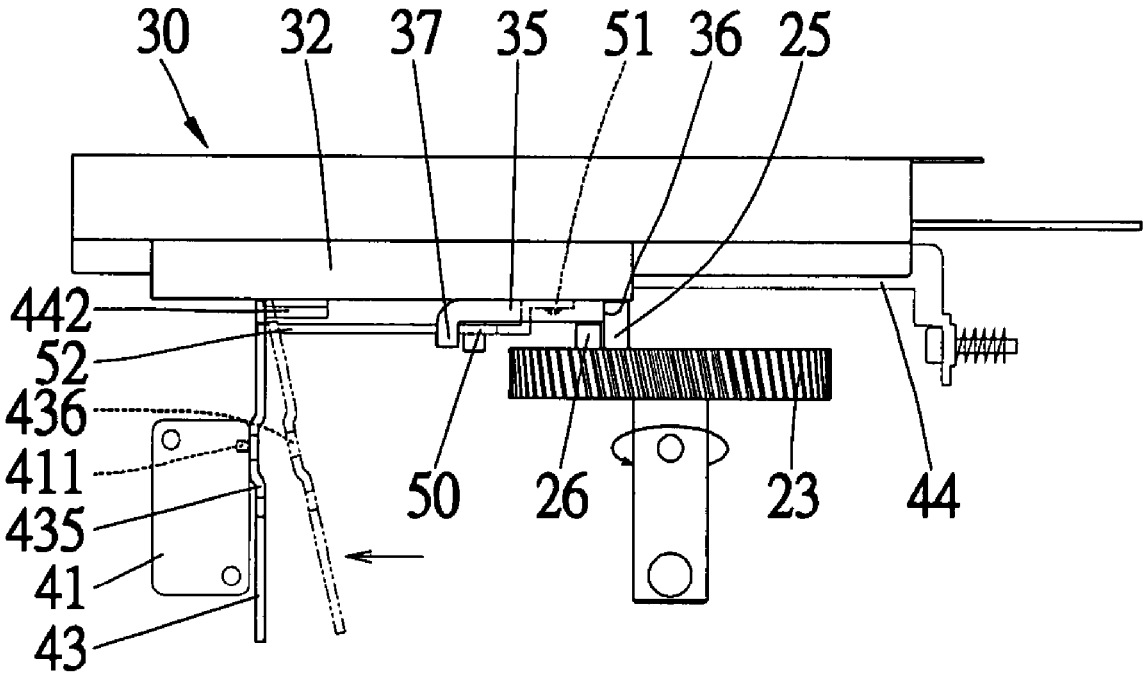
FIG. 6 is similar to FIG. 4 but shows the nail gun in another position.
Figure 7:
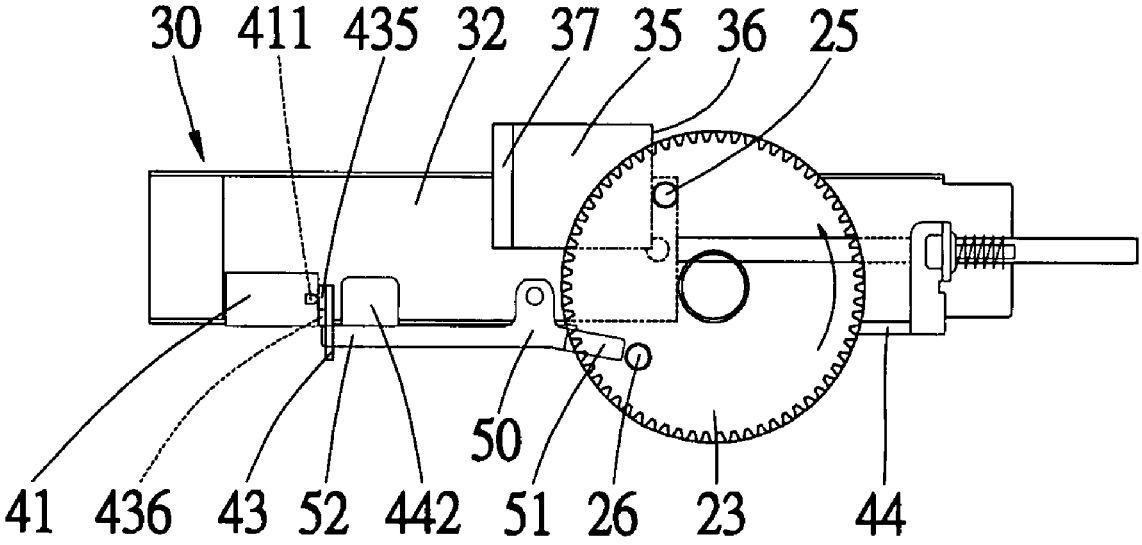
FIG. 7 is a bottom view of the nail gun of FIG. 6.
Figure 8:
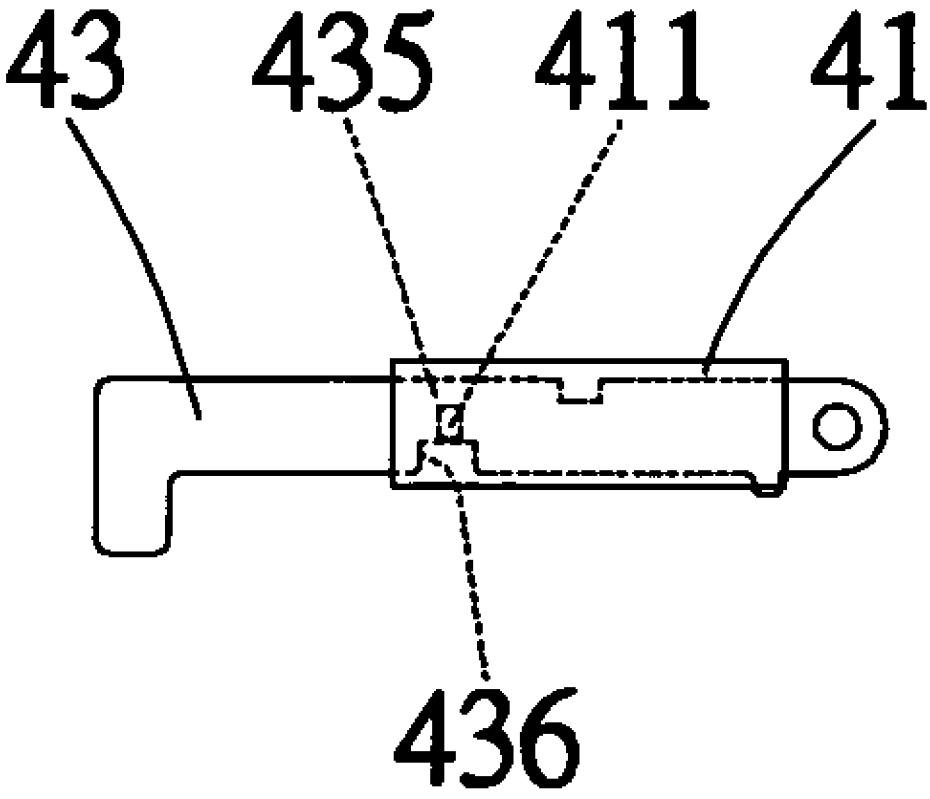
FIG. 8 is a partial view of the nail gun of FIG. 7.

Referring to FIGS. 6 through 8, the trigger 42 is pulled so that the first end of the pressing element 43 is pushed towards the switch 41. The pressing portion 435 of the pressing element 43 pushes the button 411 of the switch 41, thus actuating the motor 21. Through the transmission 22, the motor 21 drives the gear 23. The short rod 26 pushes the transverse end 37 of the tab 35 (FIGS. 4 and 5). Then, the long rod 25 contacts the co-planar end 36 of the tab 35. Then, the short rod 26 leaves the transverse end 37 of the tab 35. Thus, the gear 23 moves the hammering device 30. Later, the short rod 26 moves past the first end 51 of the lever 50.

As the gear 23 continues to rotate, the long rod 25 later leaves the co-planar end 36 of the tab 35. The springs 33 push the hammer 32 so that the pusher 34 fires a nail from the cartridge.

Figure 9:
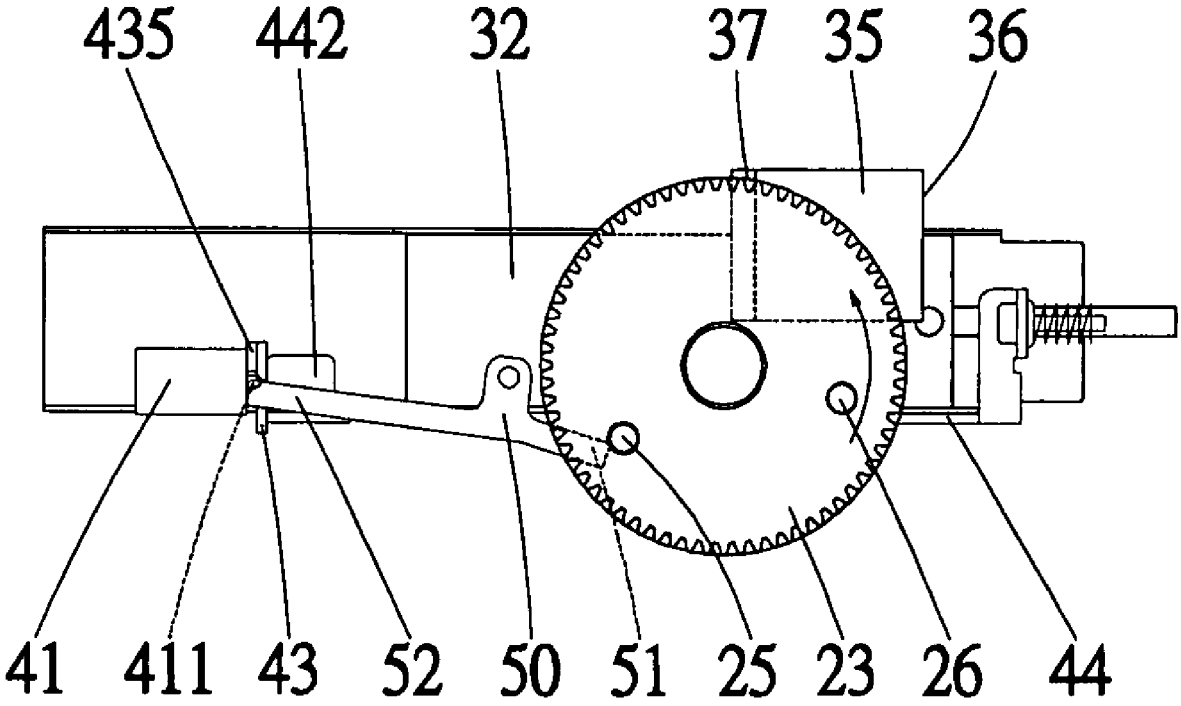
FIG. 9 is similar to FIG. 6 but shows the nail gun in another position.
Figure 10:
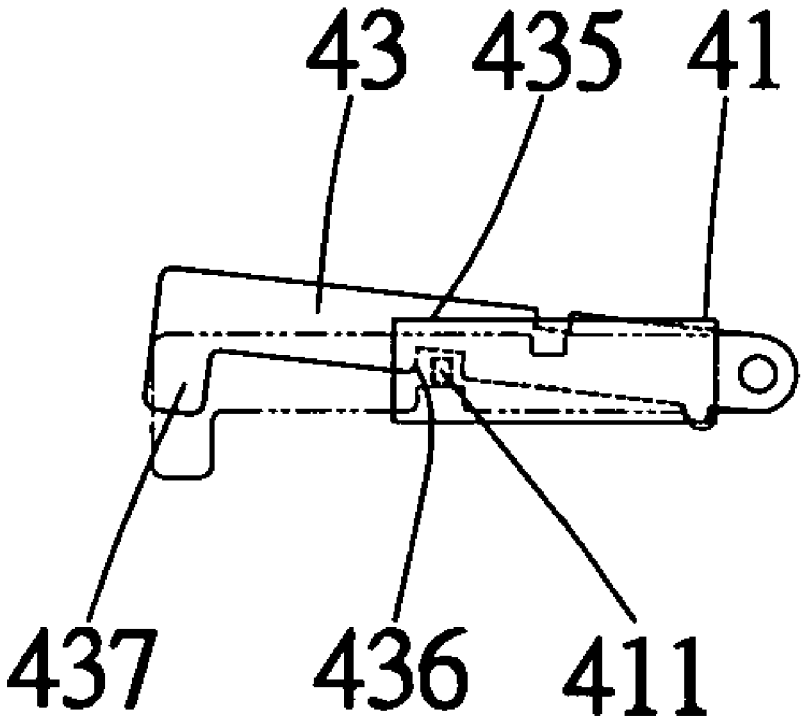
FIG. 10 is a partial bottom view of the nail gun of FIG. 9.

Referring to FIGS. 9 and 10, the gear 23 continues to rotate in order to bring the long rod 25 into contact with the first end 51 of the lever 50. Thus, the lever 50 is pivoted. The second end 52 of the lever 50 pushes the pressing element 43. The pressing element 43 is pivoted about the pin 46 so that the pressing portion 435 leaves the button 411 and that the cutout 436 receives the button 411. Thus, the pressing element 43 does not push the button 411 with the pressing portion 435.

Figure 11:
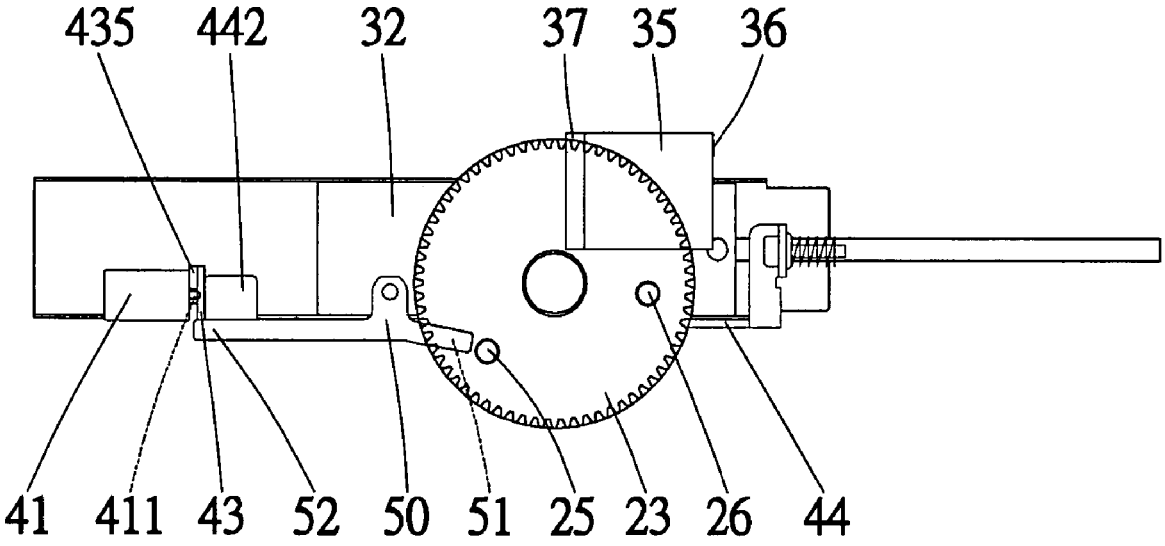
FIG. 11 is similar to FIG. 9 but shows the nail gun in another position.

For a short period of time after the button 411 is released, the motor 21 continues to operate until the gear 23 brings the long rod 25 from the first end 51 of the lever 50 (FIG. 11). As the first end of the security element 44 is still pressed against the work-piece, the second end of the security element 44 still pushes the second end of the pressing element 43. The cutout 436 still receives the button 411. The button 411 cannot be pushed even if the trigger 42 is pulled.

Figure 12:
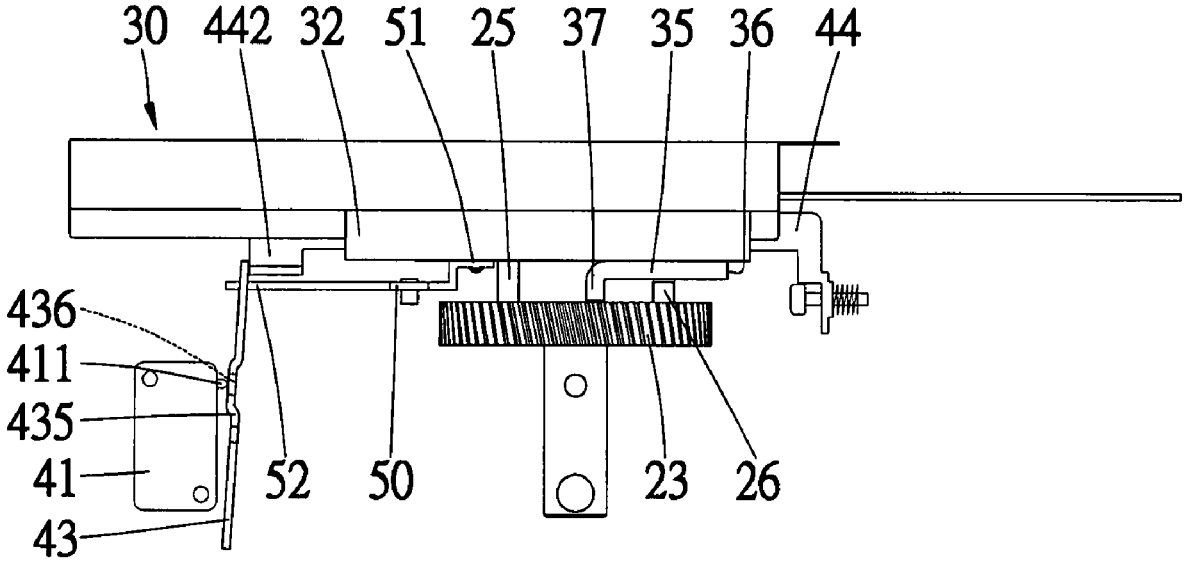
FIG. 12 is a bottom view of the nail gun of FIG. 11.

Referring to FIG. 12, to fire another nail, the first end of the security element 44 is disengaged from the work-piece, thus allowing the spring 434 to pivot the pressing element 43 about the pin 433 and cause the cutout 436 to leave the button 411. On the moment the cutout 436 leaves the button 411, the spring 434 pivots the pressing element 43 about the pin 46 and brings the pressing portion 435 into alignment with the button 411 again.

Figure 13:
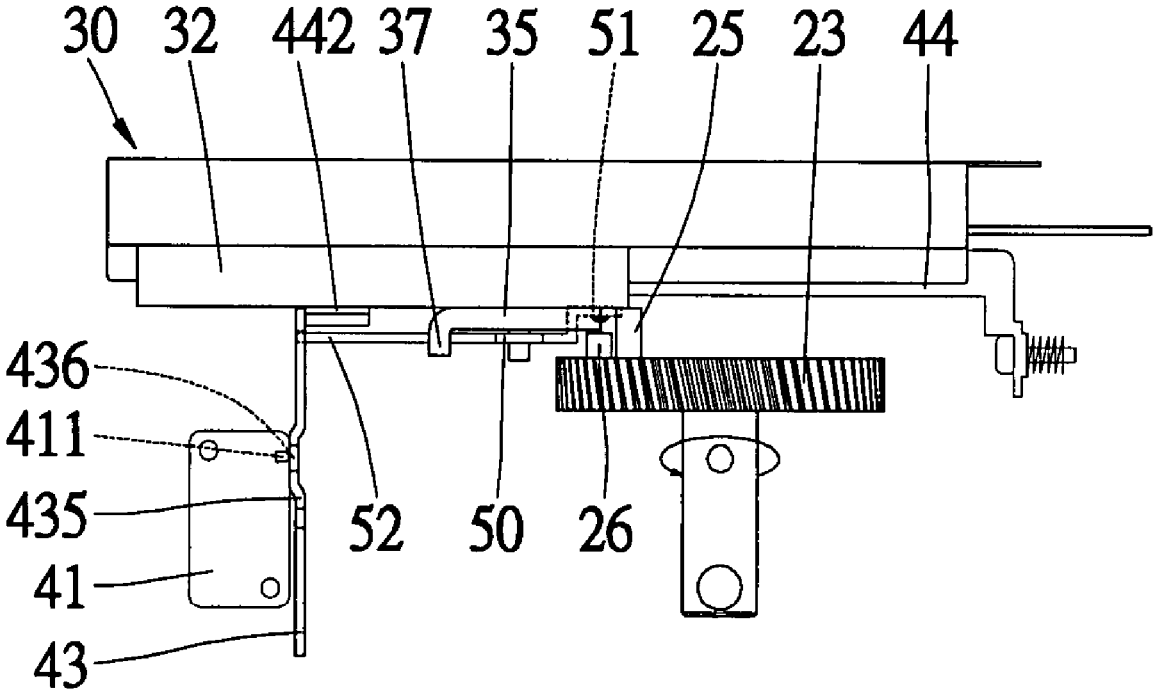
FIG. 13 is similar to FIG. 12 but shows the nail gun in another position.

Referring to FIG. 13, without the trigger 42 released, the first end of the security element 44 can be engaged with the work-piece so that the pressing portion 435 of the pressing element 43 pushes the button 411 of the switch 41 again.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A nail gun comprising a shell, a hammering device for firing nails, an energizing device for providing energy to the hammering device, an actuating device for actuating the energizing device and a lever for disabling the actuating device after a nail is fired, wherein the actuating device can be reset in order to allow the firing of one more nail, wherein the actuating device comprises:

a switch connected with the energizing device, with the switch comprising a button;

a trigger by a first pivot for pivotal movement installed on the shell for pressing the button of the switch;

a connecting element by a second pivot point connected with the trigger between a first position and a second position about a first axis;

a pressing element connected to the connecting element for pivotal movement between a first position and a second position about a second axis perpendicular to the first axis, the pressing element comprising a pressing portion and a cutout near the pressing portion, wherein the pressing portion presses the button of the switch in the second position about the first axis and in the first position about the second axis when the trigger is pulled, wherein the cutout receives the button of the switch in the second position about the first axis and in the second position about the second axis when the trigger is pulled;

a spring tending to move the pressing element to the first position about the first axis and to the first position about the second axis; and a security element installed in the shell between a first condition for leaving the pressing element in the first position about the first axis and a second condition for moving the pressing element to the second position about the first axis.

2. The nail gun according to claim 1 wherein the hammering device comprises a hammer movable in the shell and at least one spring that can be compressed by and released from the energizing device in order to push the hammer.

3. The nail gun according to claim 2 wherein the energizing device comprises a gear for driving the hammer in order to compress the spring.

4. The nail gun according to claim 3 wherein the energizing device comprises a motor for driving the gear.

5. The nail gun according to claim 1 wherein the actuating device comprises a spring tending to keep the security element in the first condition.

6. The nail gun according to claim 1 wherein the lever is pivoted between a first location for leaving the pressing element in the first position about the first axis and a second location for moving the pressing element to the second position about the first axis.

7. The nail gun according to claim 6 comprising a spring tending to keep the lever in the first location.

8. The nail gun according to claim 6 wherein a gear comprises a rod extending from a side thereof for moving the lever to the second location from the first location.

9. The nail gun according to claim 1 wherein the connection element is U-shaped, with the first axis defined by a first pin inserted in the trigger, with the connecting element installed upon the first pin, with the second axis defined by a second pin extending through the pressing element and the connecting element perpendicular to the first pin.

* * * * *